US006463901B1

(12) United States Patent
Cuddihee, Sr. et al.

(10) Patent No.: US 6,463,901 B1
(45) Date of Patent: Oct. 15, 2002

(54) METHOD AND DEVICE FOR IMPROVING AIR INTAKE FOR FUEL INJECTION ENGINES

(76) Inventors: Brendan R. Cuddihee, Sr., 4517 Emerald View Ct., Eureka, MO (US) 63025; Lavin Cuddihee, 1212 E. Walnut Ave., Orange, CA (US) 92867

( * ) Notice: Subject to any disclaimer, the term of this patent is extended or adjusted under 35 U.S.C. 154(b) by 0 days.

(21) Appl. No.: 09/536,806

(22) Filed: Mar. 28, 2000

(51) Int. Cl.[7] ..... F02M 35/10
(52) U.S. Cl. ..... 123/184.21
(58) Field of Search ..... 123/566, 559.1, 123/198 E, 184.21; 180/69.24; 55/342

(56) References Cited

U.S. PATENT DOCUMENTS

| | | | | |
|---|---|---|---|---|
| 2,133,316 A | | 10/1938 | Altgeit | |
| 2,952,327 A | | 9/1960 | Farr | |
| 3,641,746 A | | 2/1972 | Smith et al. | |
| 3,757,751 A | | 9/1973 | Kitchin et al. | |
| 3,826,237 A | * | 7/1974 | Csicsery et al. | 123/179.17 |
| 3,973,937 A | | 8/1976 | Petersen | |
| 3,987,862 A | | 10/1976 | Lidstone | |
| 4,013,137 A | | 3/1977 | Petersen | |
| 4,014,673 A | | 3/1977 | Kinnison | |
| 4,201,557 A | | 5/1980 | Petersen | |
| 4,373,940 A | | 2/1983 | Petersen | |
| 4,420,057 A | | 12/1983 | Omote | |
| 4,459,141 A | | 7/1984 | Burrington et al. | 55/391 |
| 4,516,650 A | | 5/1985 | Yamaguchi et al. | 180/68.3 |
| 4,533,012 A | | 8/1985 | Komoda | 180/68.3 |
| 4,629,022 A | * | 12/1986 | Wayne et al. | 180/69.24 |
| 4,681,178 A | | 7/1987 | Brown | 180/68.3 |
| 4,772,299 A | | 9/1988 | Bogusz | 55/385 |
| 4,889,516 A | * | 12/1989 | Auer et al. | 446/462 |
| 4,932,490 A | | 6/1990 | Dewey | 180/68.3 |
| 5,042,603 A | | 8/1991 | Olson | 180/68.3 |
| D328,063 S | | 7/1992 | Yunes | D12/181 |
| 5,195,484 A | | 3/1993 | Knapp | 123/198 |
| 5,251,712 A | | 10/1993 | Hayashi et al. | 180/68.3 |
| 5,559,379 A | * | 9/1996 | Voss | 310/63 |
| 6,098,586 A | * | 8/2000 | Bloomer | 123/184.21 |

OTHER PUBLICATIONS

Photographs of 1978 Pontiac Firebird Trans Am.*
"Off Road Jan, 1996" Fuel injection resurrection: how to give your truck's TBI system a shot in the arm by Matt Hardesty.*
"1978 Pontiac Firebird Trans Am" www.iwaynet.com/~gllisk/1978&..html.
"Trans Am Shaker hoodscoops and Air cleaners" www.thepontiactransampage.com/shaker.html.
"1978 Trans Am Shaker Air Cleaner" www.thepontiactransampage.com/aircleaner.html.
"Pontiac Trans Am Shaker" http://pontiactransamshaker-s.homestead.com/index~ns4.html.

* cited by examiner

*Primary Examiner*—Gene Mancene
*Assistant Examiner*—Hyder Ali
(74) *Attorney, Agent, or Firm*—Davidson, Davidson & Kappel, LLC

(57) ABSTRACT

A fuel injection automobile includes a fuel injection engine, the fuel injection engine having an air box for providing air to an air inlet; a hood covering the fuel injection engine and having an opening; and an air collector fixed to a top of the fuel injection engine(protruding through the opening and connected to the air box. Also provided is a method for retrofitting an automobile having a fuel injection engine comprising the steps of cutting a hole in a hood of the automobile; removing a factory-installed air box; providing a new air box having an air box input; attaching an air collector to a top of the fuel injection engine so as to protrude through the hole; and connecting the air collector between the air box input and the air collector.

19 Claims, 5 Drawing Sheets

METHOD AND DEVICE FOR IMPROVING AIR INTAKE FOR FUEL INJECTION ENGINES

BACKGROUND OF THE INVENTION

1. Field of the Invention

The present invention relates generally to automobiles and more particularly to a method and device for improving air intake for fuel injection engines.

2. Background Information

Air intake systems for carburetor engines in the 1960s and 1970s sometimes included an air scoop extending from the hood. Such systems included a factory installed option called a shaker air system in which the scoop extended through the hood. Such systems were available as options for example on Ford Mustangs from 1969 and 1970 and the Dodge Challenger from 1970 and 1971.

These air intakes aided in providing the large amounts of air necessary for powerful carburetor engines, and fed the air directly through the scoop to an air filter at the top of the engine.

With the advent of fuel injection engines, the carburetor disappeared, and along with it the air scoop. Conventional fuel injection engines accepted air through, for example, the wheel well, fed the air through a factory installed air box. For example, the 1986 to 1993 Ford Mustang 5.0 Liter Fuel Injection automobiles have an air box which accepts air from a wheel well. A top plate on the fuel injection engine is fastened through four screws and has information concerning the engine.

To date, fuel injection engines, which have been in use for decades, have not used air intakes protruding though a hood.

SUMMARY OF THE INVENTION

An object of the present invention is to provide for better air intake for fuel injection engines. Another object is to provide a simple remodification of existing fuel injection engines to provide for better air intake.

The present invention provides an automobile comprising a fuel injection engine, the fuel injection engine having an air box for providing air to an air inlet, a hood covering the fuel injection engine and having an opening, and an air collector fixed to a top of the fuel injection engine protruding through the opening and connected to the air box.

The present invention permits for better air intake while permitting stability and reliability of the air intake system. The protruding nature of the air collector increases air flow for fuel injection engines. A constant reservoir of high density cool air thus can be provided to an air metering system of the fuel injection engine.

Moreover, since the air collector is fixed to the fuel injection engine rather than the hood, a connection between the air box and the air collector does not suffer excessive vibrations.

The air collector preferably has a lower shell and an upper shell, the lower shell being fixed to the top of the fuel injection engine by a plurality of screws. The upper shell preferably is fixed to the lower shell by screws. A rubber seal may be provided around the upper shell to aid in sealing the engine compartment with respect to the hood.

A plurality of drainage tubes may be provided to drain water which collects in the air collector. A grill may also be provided over an entrance of the air collector to reduce particles entering the air collector.

The air box preferably is located to the side of the fuel injection engine and includes an air filter. A connector between the air box and the air collector is provided, preferably made of a spiral wound high temperature resistant composite tube. The connector preferably is connected to the lower shell and passes over part of the top of the fuel injection engine.

The present invention also provides a fuel injection engine comprising an air box for providing air to an air inlet, and an air collector fixed to a top side of the fuel injection engine, the air collector protruding through the hood and connected to the air box.

The present invention also provides a method for retrofitting an automobile having a fuel injection engine comprising the steps of:

cutting a hole in a hood of the automobile;

removing a factory-installed air box;

providing a new air box having an air box input;

attaching an air collector to a top of the fuel injection engine so as to protrude through the hole;

and connecting the air collector between the air box input and the air collector.

The method further provides removing a fuel injection engine decorative plate from the top of the fuel injection engine and connecting a bottom shell of the air collector to holes for the removed decorative plate.

The method also further provides for sealing edges in the hole using a rubber seal.

In a preferred embodiment, the air box inlet is at a top side of the new air box, which is attached to existing factory mounts.

The connecting step may be accomplished using a temperature resistant ducting tube.

BRIEF DESCRIPTION OF THE DRAWINGS

The present invention may be better understood with reference to the following figures in which.

DETAILED DESCRIPTION

Figure 1:
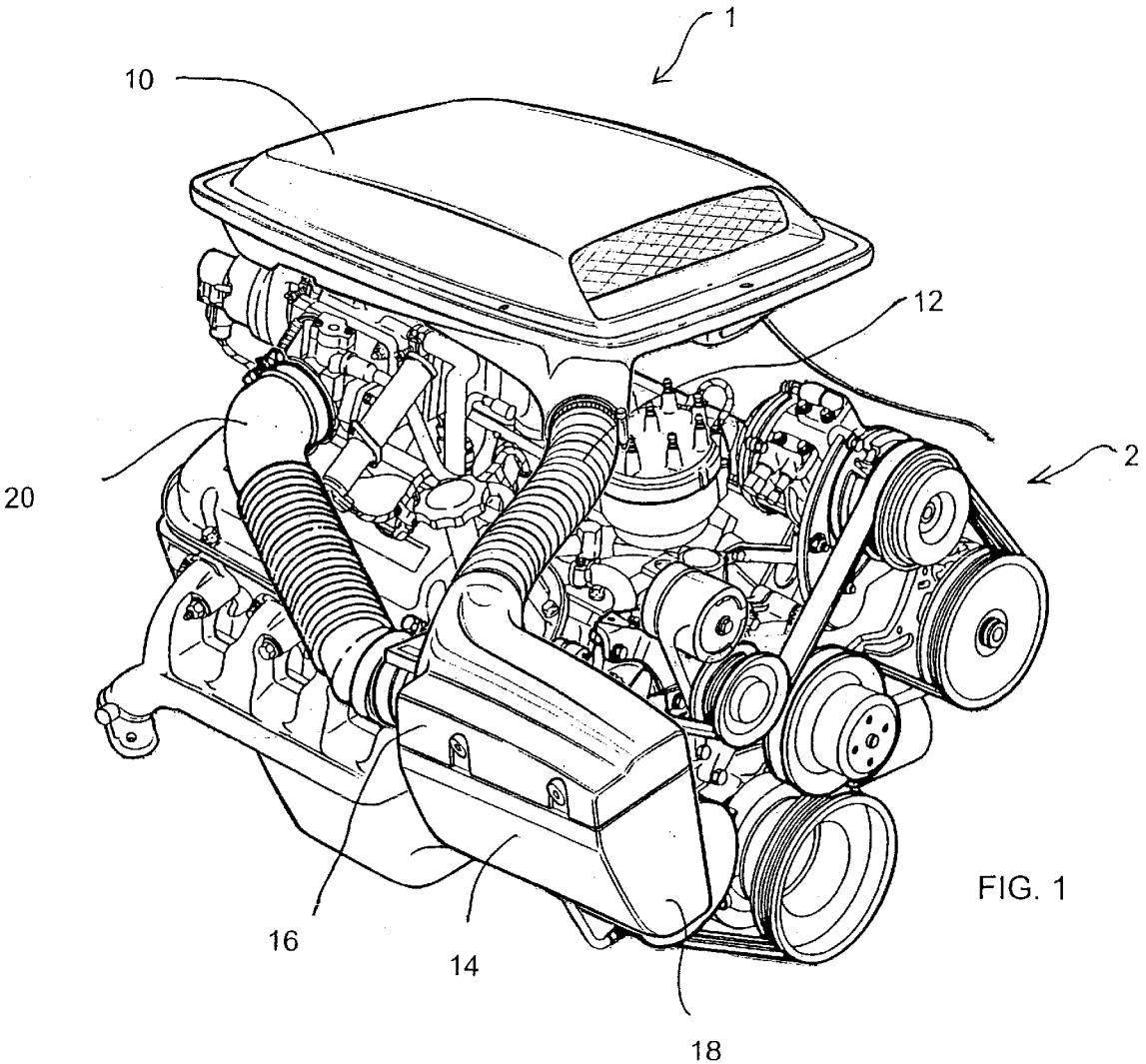
FIG. 1 shows a schematic view of the air intake device of the present invention mounted on a fuel-injection motor.

FIG. 1 shows an air intake device 1 attached to a fuel injection internal combustion engine 2. Air intake device 1 includes an air collector 10 attached to a top side of engine 2. A connector 12 preferably made of a high temperature resistant composite tube transfers air from the air collector 10 to an air box 14 at a side of the fuel injection engine 2. The air box 14 has a top section 16 and a bottom section 18. A second tube 20 transfers air from the air box 14 to an air intake of the internal combustion engine 2.

Figure 2:
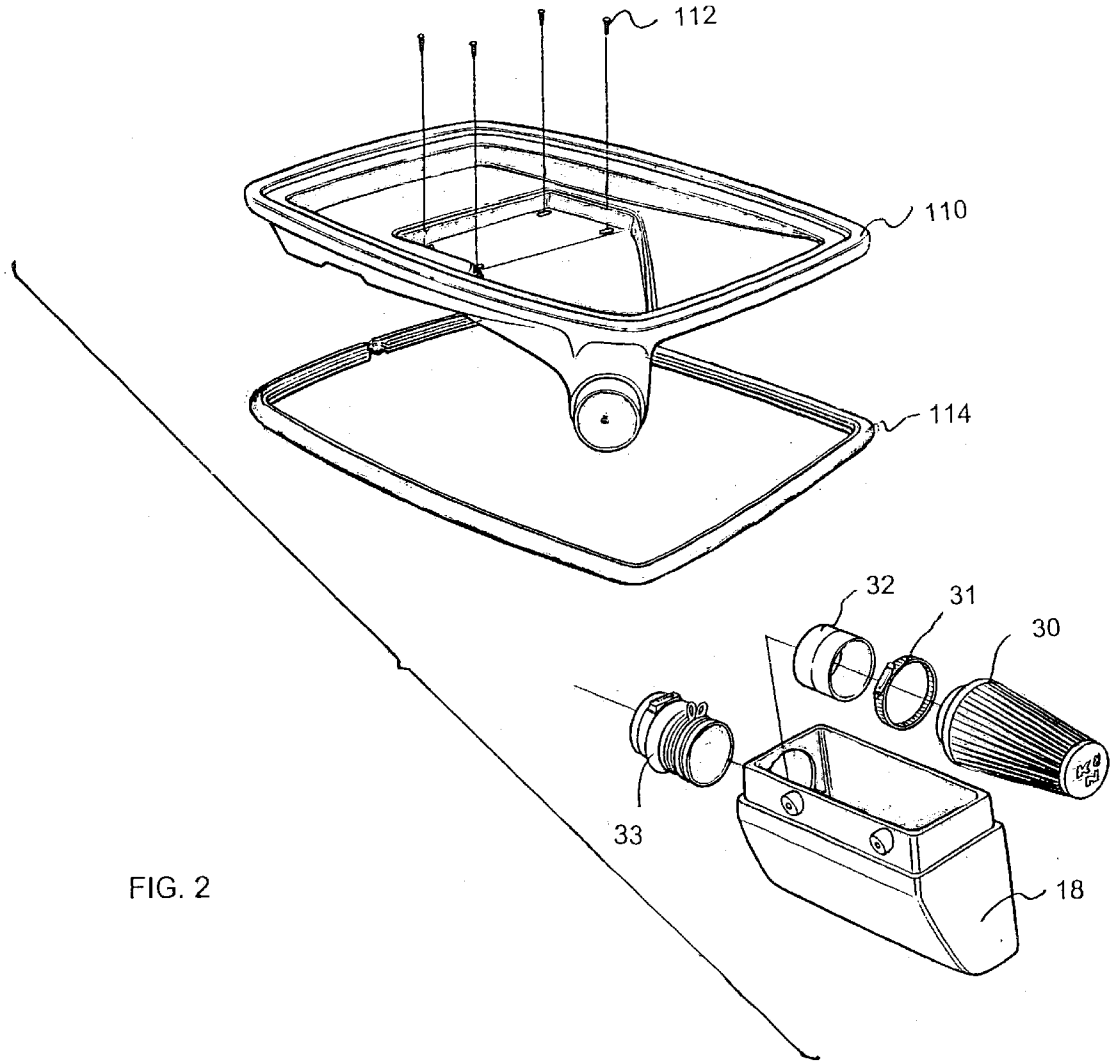
FIG. 2 shows the various parts of the air intake device of the present invention.
Figure 3:
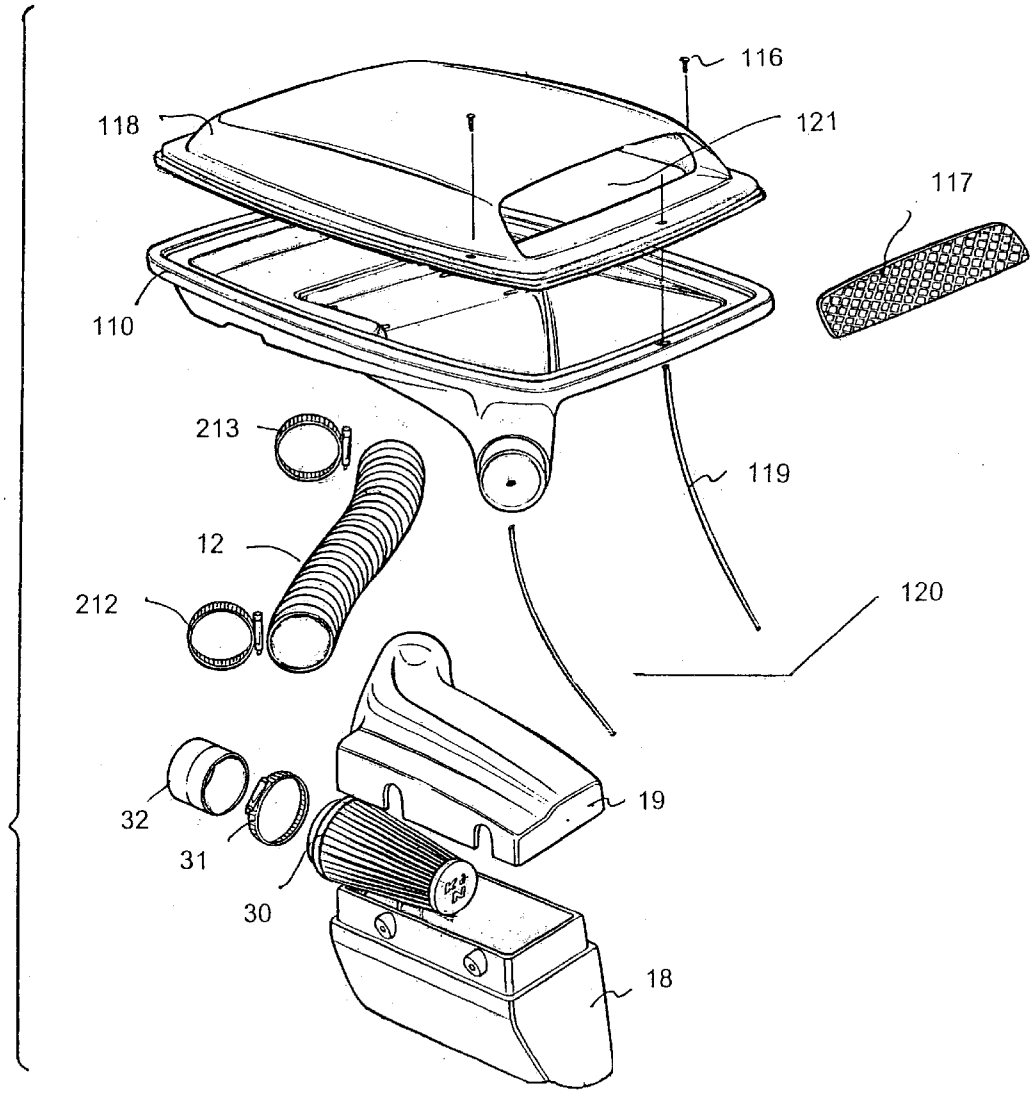
FIG. 3 shows several details of the air intake device of FIG. 1.
Figure 5:
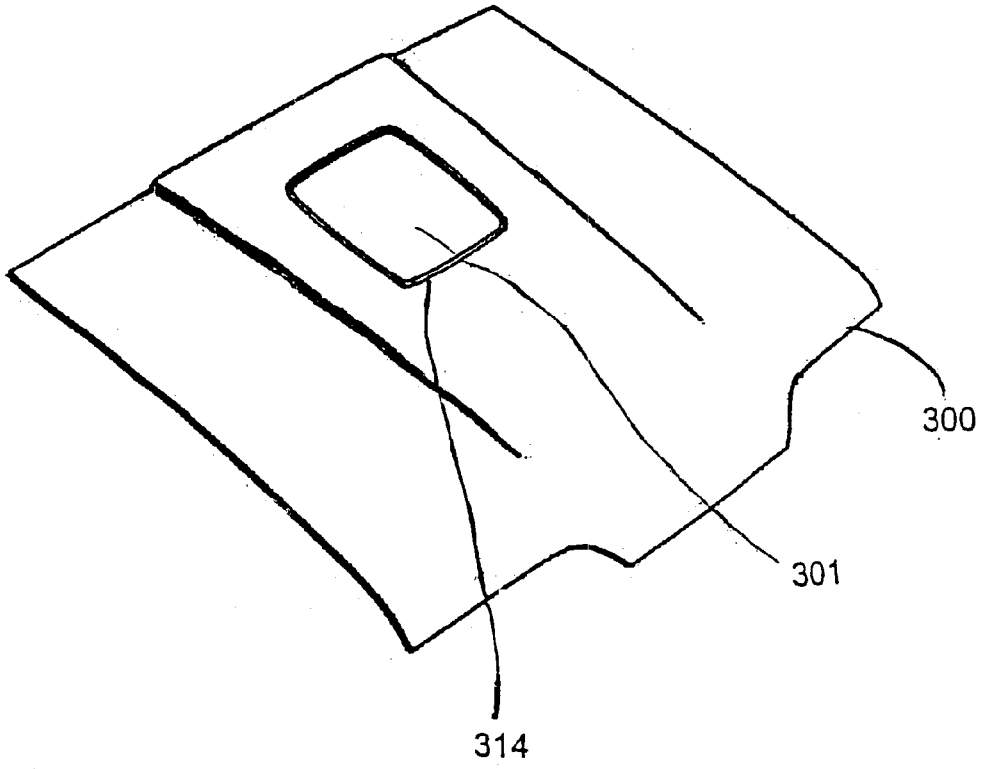
FIG. 5 shows a hood of a car modified according to the method of the present invention.

FIGS. 2 and 3 show various parts of air intake device 1. Air collector 10 is comprised of a bottom shell 110 and a top shell 118, which are fastened together by screws 116. Bottom shell 110 is fastened by screws 112 to four holes in a top of fuel injection engine 2, which originally were for a decorative plate. A rubber seal 114 can be provided about shell 118 and provide for extra sealing with the underside of the hood. As shown in FIG. 5, alternately or additionally a close out trim 314 can be provided to finish out a hole 301 in a hood 300. As shown in FIG. 3, air collector 10 also includes two drainage hoses 119, 120 for draining water, and a grill 117 for an air intake opening 121.

Air collector 10 is connected to air box 14 by connector 12, which may be fastened by ring fasteners 213 and 212, although these are not absolutely necessary. Air box 14 includes an air filter 30, which may be connected by a ring fastener 31 to a sleeve 32 and a connector 33, for feeding air to second tube 20.

Both connector 33 and second air tube 20 may be stock parts of an existing engine.

Figure 4:
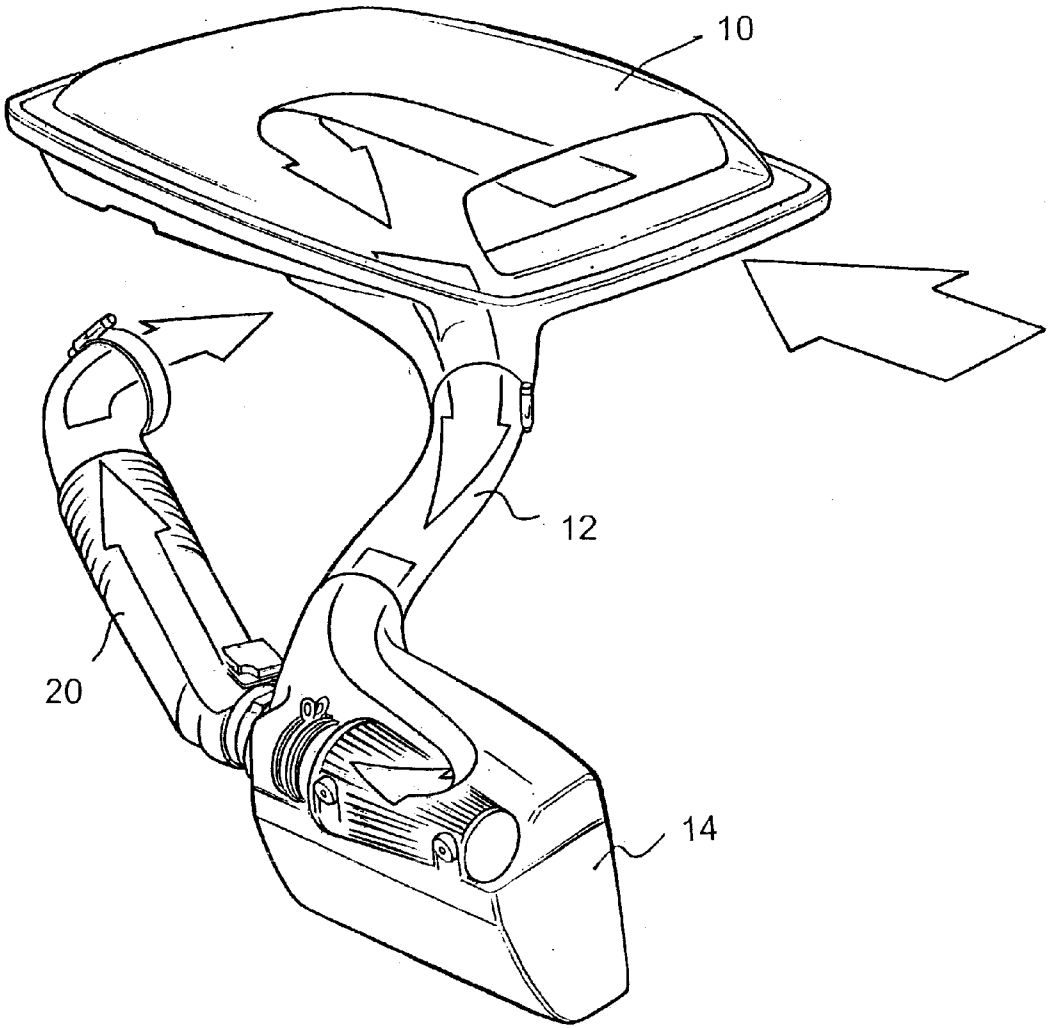
FIG. 4 shows schematically the flow of air through the air intake device of FIG.1.

FIG. 4 shows the flow of air through air collector 10, connector 12, air box 14 and second tube 20.

In a preferred embodiment, the air intake device is installed as a modification of an existing fuel injection engine. The steps for this installation are as follows:

1. A factory installed air box is removed.
2. A new air box 14 is installed to the factory mounts.
3. The air collector base 110 is fastened by screws 112 via screw holes freed by removal of a decorative engine identification plate.
4. A supplied template is used to cut a hole 301 in the hood 300 of the vehicle, the hole being slightly larger than the top shell 118. An edge of the hole may be sealed with a close out trim part.
5. The air collector top shell 118 is attached to the bottom shell using screws 116.
6. The air collector 10 is attached to the air box 14 with connector 12.

The air box 14 and air collector 10 preferably are made of high density and high temperature resistant urethane. Grill 117 is preferably made of metal.

What is claimed is:

1. A fuel injection automobile comprising:

a fuel injection engine, the fuel injection engine having an air box for providing air to an air inlet;

a hood covering the fuel injection engine and having an opening; and an air collector fixed to a top of the fuel injection engine protruding through the opening and connected to the air box.

2. The fuel injection automobile as recited in claim 1 wherein the air collector has a lower shell and an upper shell, the lower shell being fixed to the top of the fuel injection engine by a plurality of screws.

3. The fuel injection automobile as recited in claim 2 wherein the connector is connected to the lower shell and passes over part of the top of the fuel injection engine.

4. The fuel injection automobile as recited in claim 1 further comprising a plurality of drainage tubes connected to the air collector.

5. The fuel injection automobile as recited in claim 1 wherein the air box is located to a side of the fuel injection engine and includes an air filter.

6. The fuel injection automobile as recited in claim 1 further comprising a connector between the air box and the air collector made of a spiral wound high temperature resistant composite tube.

7. The fuel injection automobile as recited in claim 1 further comprising a connector directly connecting the air collector to the air box and providing air to the air box.

8. The fuel injection automobile as recited in claim 7 wherein the air box is at a side of the engine.

9. The fuel injection automobile as recited in claim 1 wherein the air collector is a primary air source for the air box.

10. The fuel injection automobile as recited in claim 1 further comprising a connector directly connecting the air collector to the air box and providing air to the air box, the air collector having a bottom shell and a top shell and the air box having an air filter.

11. The fuel injection: automobile as recited in claim 10 wherein the air box is at a side of the engine.

12. The fuel injection automobile as recited in claim 1 further comprising a connector connected to the air box and wherein the air collector is a primary air source for the air box, and has a bottom shell directly connected to the connector, the air box having an air filter.

13. The fuel injection automobile as recited in claim 1 wherein air box includes an air filter.

14. The fuel injection automobile as recited in claim 13 wherein the air box includes a removable top connected to the connector.

15. A method for retrofitting an automobile having a fuel injection engine comprising the steps of:

cutting a hole in a hood of the automobile;

removing a factory-installed air box;

providing a new air box having an air box input;

attaching an air collector to a top of the fuel injection engine so as to protrude through the hole; and connecting the air collector between the air box input and the air collector.

16. The method as recited in claim 15 further comprising the step of removing a fuel injection engine decorative plate from the top of the fuel injection engine and connecting a bottom shell of the air collector to holes for the removed decorative plate.

17. The method as recited in claim 15 further comprising sealing edges in the hole using a rubber seal.

18. The method as recited in claim 15 wherein the cutting step includes using a template.

19. The method as recited in claim 15 wherein the air box input is at a top side of the new air box, which is attached to existing factory mounts.

* * * * *